US005754661A

United States Patent [19]

Weinfurtner

[11] Patent Number: 5,754,661

[45] Date of Patent: May 19, 1998

[54] PROGRAMMABLE HEARING AID

[75] Inventor: Oliver Weinfurtner, Erlangen, Germany

[73] Assignee: Siemens Audiologische Technik GmbH, Erlangen, Germany

[21] Appl. No.: 515,907

[22] Filed: Aug. 16, 1995

[30] Foreign Application Priority Data

Nov. 10, 1994 [EP] European Pat. Off. ..... 94117795

[51] Int. Cl.[6] ..... H04R 25/00

[52] U.S. Cl. ..... 381/68.2; 381/68; 395/2.11; 395/3

[58] Field of Search ..... 381/68–69.2; 395/2.11, 395/3; 600/25, 27

[56] References Cited

U.S. PATENT DOCUMENTS

| | | | |
|---|---|---|---|
| 4,425,481 | 1/1984 | Mansgold et al. | 381/68 |
| 4,622,440 | 11/1986 | Slavin | 381/68.1 |
| 4,845,755 | 7/1989 | Busch et al. | 381/68 |
| 4,903,226 | 2/1990 | Tsidivis | 364/807 |
| 4,961,002 | 10/1990 | Tam et al. | 307/201 |
| 5,040,215 | 8/1991 | Amano et al. | 381/43 |
| 5,172,417 | 12/1992 | Iwamura | 381/103 |
| 5,179,624 | 1/1993 | Amano et al. | 381/43 |
| 5,218,542 | 6/1993 | Endo et al. | 180/169 |
| 5,351,200 | 9/1994 | Impink | 364/550 |
| 5,434,926 | 7/1995 | Watanabe | 381/86 |
| 5,448,644 | 9/1995 | Pfannenumueller | 381/68 |
| 5,636,285 | 6/1997 | Sauer | 381/68.2 |

FOREIGN PATENT DOCUMENTS

| | | | |
|---|---|---|---|
| 0 064 042 | 11/1982 | European Pat. Off. . | |
| 0 250 679 | 1/1988 | European Pat. Off. . | |
| 0 579 152 A1 | 1/1994 | European Pat. Off. . | |
| 2-72398 | 3/1990 | Japan | 395/2.42 |
| WO 91/08654 | 6/1991 | WIPO . | |
| WO 93/26037 | 12/1993 | WIPO . | |

OTHER PUBLICATIONS

Neuronale netze Unterstützen Fuzzy–Logik–Tool, Trautzl Elektronik, vol. 2, 1992, pp. 100–101.

*Primary Examiner*—Curtis Kuntz
*Assistant Examiner*—Rexford N. Barnie
*Attorney, Agent, or Firm*—Hill & Simpson

[57] ABSTRACT

A programmable hearing aid has improved signal processing, particularly improved separation of the useful signals from unwanted noise, by virtue of signals of the signal path from at least one microphone to the earphone being conducted through a neural network and being processed therein.

35 Claims, 8 Drawing Sheets

PROGRAMMABLE HEARING AID

BACKGROUND OF THE INVENTION

1. Field of the Invention

The present invention is directed to a programmable hearing aid of the type having an amplifier and transmission stage, connected between at least one microphone and an earphone, that can be adjusted to different transmission characteristics so as to vary transmission properties between each microphone and the earphone.

2. Description of the Prior Art

European Patent 0 064 042 discloses a circuit arrangement for a hearing aid, wherein the parameters of a number of different ambient situations, for example, are stored in the hearing aid itself in a memory. By actuating a switch, a first group of parameters is fetched and, via a control unit, is used to control a signal processor connected between the microphone and the earphone, which sets a transmission function intended for a given ambient situation. The transmission functions of a number of stored signal transmission programs can thus be successively fetched via the switch until the transmission function that matches the current ambient situation has been found.

It is consequently known to match hearing aids to the individual hearing loss of the hearing aid wearer. The capability of a setting the hearing aid for various auditory situations is also provided. Programmable hearing aids offer a number of adjustable parameters that are intended to enable a matching of the electro-acoustic behavior of the hearing aid to the hearing impairment to be compensated which is as accurate as possible.

SUMMARY OF THE INVENTION

An object of the present invention is to provide a programmable hearing aid having improved signal processing in comparison to known programmable hearing aids and that, in particular, enables an improved separation of useful signals from unwanted sound.

This object is inventively achieved in a hearing aid of the type initially described wherein signals of the signal path from the microphone to the earphone are conducted via a neural network and are processed therein. The use of a neural network enables new methods and algorithms of signal processing in the hearing aid. Among other things, better separation of different signals, i.e., for example, separation of useful signals and unwanted noise, is thus possible. The behavior of the signal processing can thereby be fixed or programmable or variable in order during operation to continuously adapt to the signal to be processed.

In an embodiment of the invention, a separation of useful signals and unwanted signals ensues in the neural network. The neural network simultaneously processes a plurality of input signals. Two possible approaches arise therefrom for employment in the hearing aid:

Only one microphone is utilized and the signal picked up therewith—possibly after previous, other processing in the signal path—is converted into a plurality of discrete signals by suitable pre-processing, for example by division into different frequency ranges. These discrete signals are then supplied to the neural structure.

More than one microphone is utilized and these individual signals—possible after previous, other processing in the signal path—are supplied to the neural structure.

DESCRIPTION OF THE PREFERRED EMBODIMENTS

Figure 1:
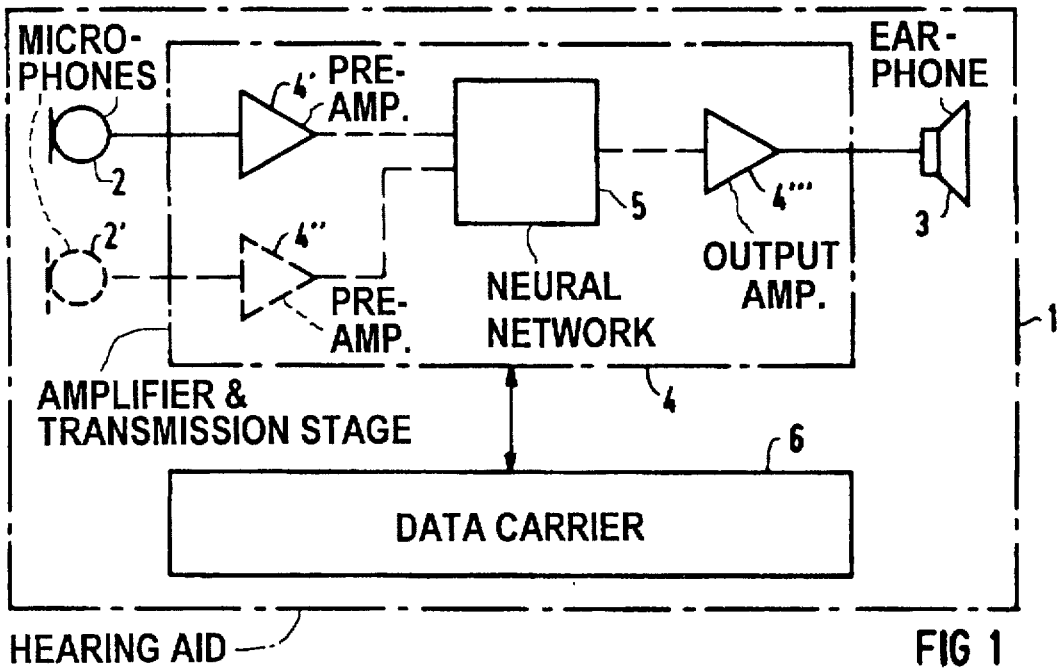
FIG. 1 is a block circuit diagram of an inventive hearing aid.

The hearing aid 1 of the invention schematically shown in FIG. 1 picks up sound signals via a microphone 2 or further microphones 2'. This acoustic information is converted into electrical signals in the microphone or microphones. After signal preprocessing in a amplification and transmission stage 4, the electrical signal is supplied to an earphone 3 as an output transducer. In the exemplary embodiment, only pre-amplifiers 4', 4" and an output amplifier 4'" are separately shown in the amplifier and transmission stage 4, however it will be understood that other components may be present as well. According to the invention, the amplifier and transmission stage 4 also includes a neural network 5 connected such that signals of the signal path from at least one microphone 2 and/or 2' are conducted to the earphone 3 via the neural network 5 and are processed therein for the purpose of obtaining an improved signal processing, particularly an improved separation of the useful signals from unwanted noise. The neural network 5 has a data carrier 6 allocated to it wherein configuration information of the neural structure is programmed or is permanently stored.

Figure 2:
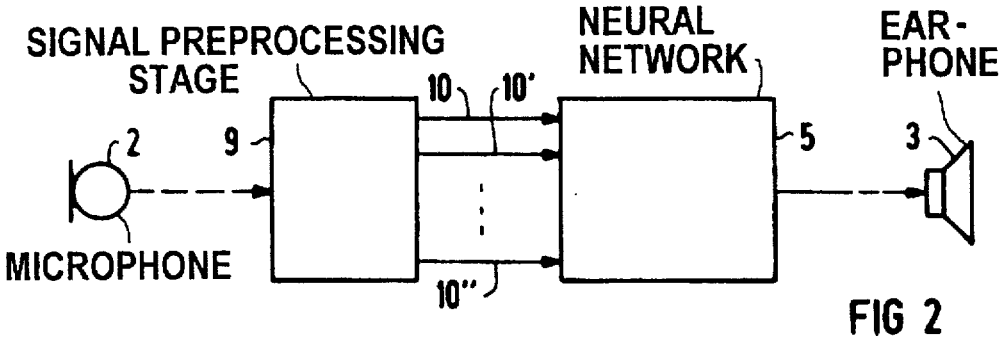
FIG. 2 illustrates a signal path from a microphone via signal pre-processing stage and a neural network to the earphone in a first embodiment of the hearing aid of FIG. 1.

In an embodiment according to FIG. 2, a signal preprocessing circuit 9 for preprocessing of the input signal into a number of sub-signals 10, 10', 10" precedes the neural network 5 in the signal path from the microphone 2, whereby the sub-signals are then further-processed in the neural network 5. Taking the configuration information of the data carrier 6 into consideration, the neural network 5 generates one output signal from the edited sub-signals 10, 10', 10", particularly a useful signal separated from unwanted noise which, for example, is then further-processed in known components of the amplifier and transmission stage 4 and is supplied to the earphone 3 via the output amplifier 4'".

Examples for realizing the neural structure of the neural network 5 shall be set forth with reference to FIGS. 3–9.

Neural structures are composed of many identical elements, known as neurons, 19. The function of the neural structure as a whole is essentially dependent on the type of interconnection of these neurons 19 to one another.

Figure 3:
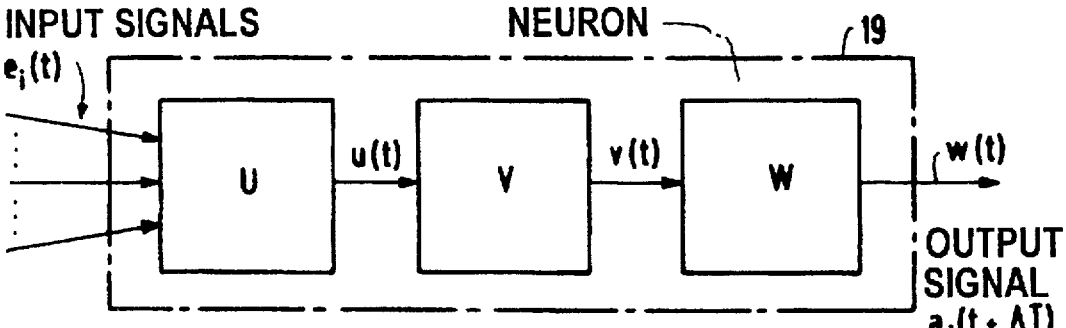
FIG. 3 is a block circuit diagram of a single neuron in the neural network of the inventive hearing aid.

FIG. 3 shows the block circuit diagram of an individual neuron 19. The neuron generates the output signal $a_j(t+\Delta T)$ at time $t+\Delta T$ from a theoretically arbitrary number of input signals $e_i(t)$ at time t. Its function can be resolved into three basic functions:

propagation function U: $u(t)=\Sigma e_i(t).w_i$; the output quantity of this function is the sum of all input signals respectively multiplied by the individual synaptic weight $w_i$.

activation function V: $v(t)=f(u(t))$; in the general case, the prior history of the output quantity also enters into the output quantity. In many instances, however, this can be forgone, v(t) at time $t=t_0$ is then only a function of u(t) at time $t=t_0$.

output function W: w(t);

This undertakes a threshold formation. Two fundamental types of threshold formation are thereby possible.

Figure 4A:
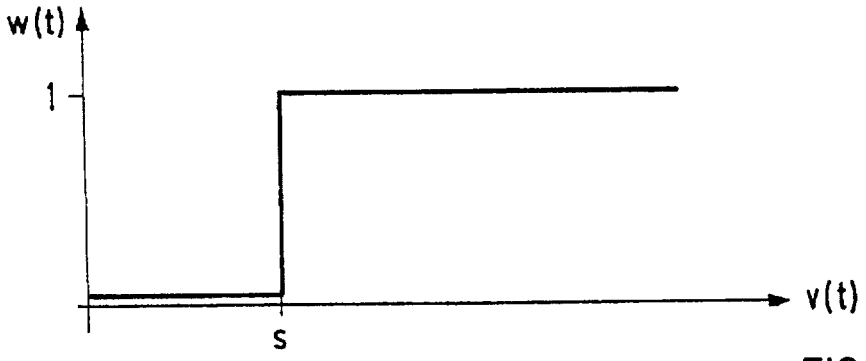
FIGS. 4*a*, 4*b*, 4*c* illustrate examples of threshold curves of the output function W according to FIG. 3.

According to FIG. 4*a*, the curve of the output function W represents a step function at the threshold s.

Figure 4B:
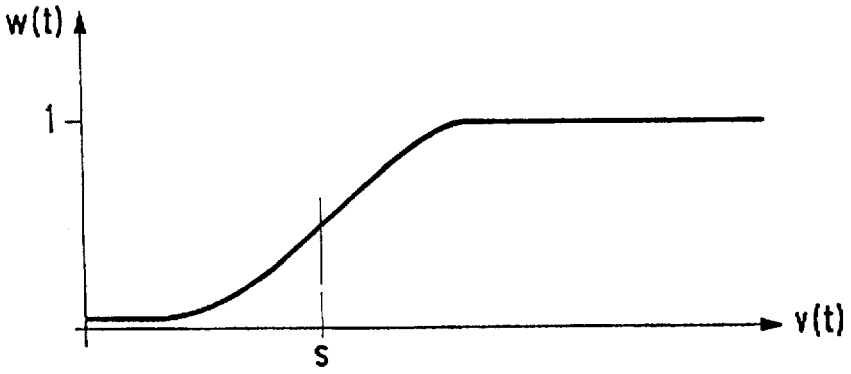
Figure 4C:
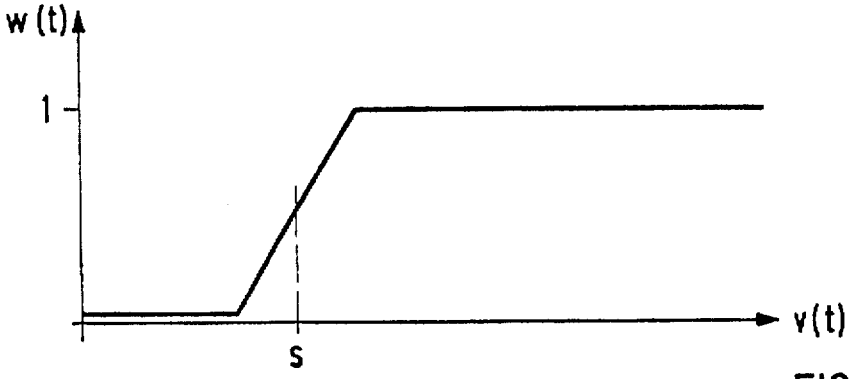

According to FIGS. 4*b* and 4*c*, the output function W has a steady course around the threshold s. FIG. 4*b* shows a steady, so-called sigmoidal course of the output quantity with limitation to a maximum and to a minimum output value. A frequently employed characteristic is thereby the sigmoid: $w(t)=1/(1+\exp(-(v(t)-s)))$. FIG. 4*c* shows a linear course in the transmission region.

The signals that are processed by the neural structure can be voltage signals, current signals or frequency-variable pulse signals. In the latter case, the signal must possibly be converted into a continuous current or voltage signal and back at some locations of the neural structure by means of suitable conversion circuits.

Figure 5:
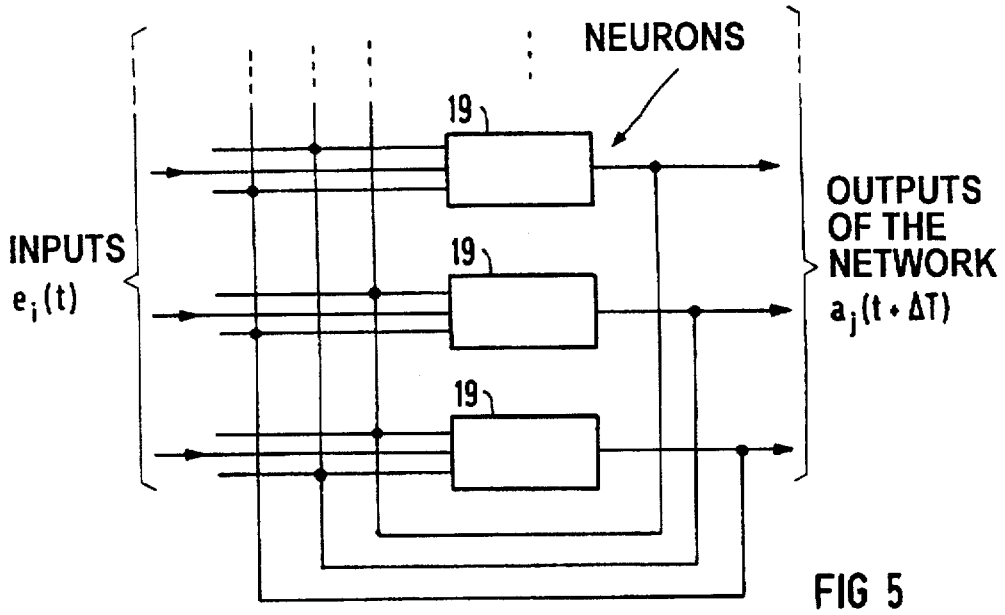
FIG. 5 illustrates a single-layer, feedback network with an exemplary interconnection of three neurons suitable for use in the invention hearing aid.

FIG. 5 shows the exemplary interconnection of three neurons 19 for the typical structure of a single-layer feedback network having the inputs $e_i(t)$ and the outputs $a_j(t+\Delta T)$.

Figure 6:
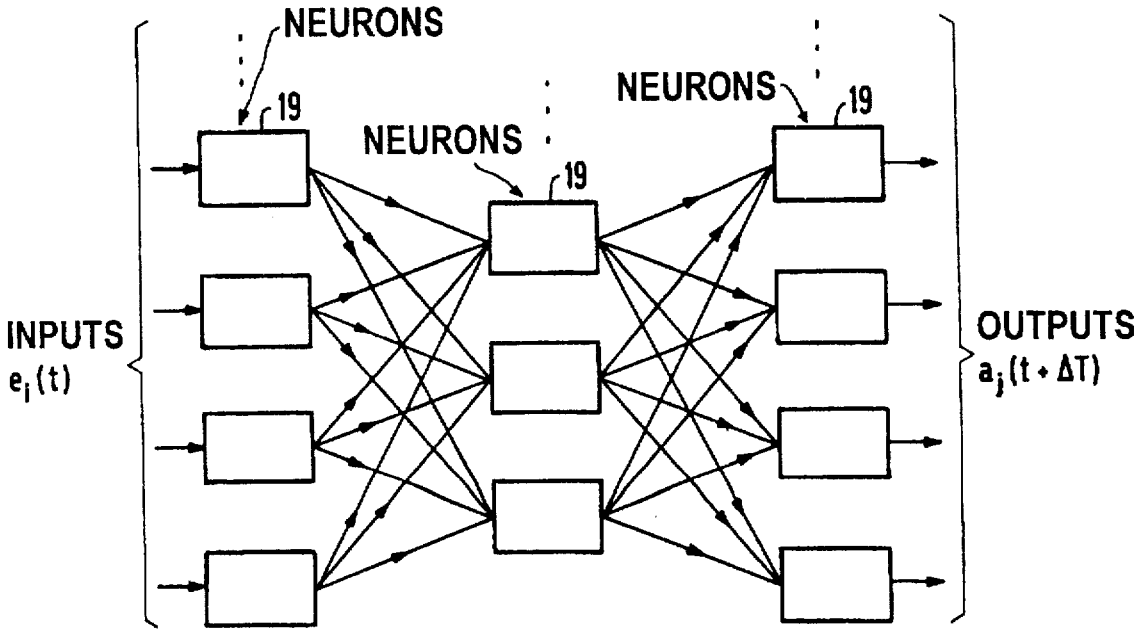
FIG. 6 illustrates a multi-layer, feedback-free network having an exemplary interconnection of eleven neurons in three layers suitable for use in the invention hearing aid.

FIG. 6 shows the exemplary structure of a multi-layer feedback-free network. Dependent on the function of the neural structure to be implemented, one or the other network structure is employed. Mixed forms of the two structures are also possible.

The function of a neural structure as a whole is essentially defined by the network structure and by the weighting functions of the input signals at each neuron 19. These parameters can be permanently set by the circuit realization if constant, unchanging behavior is desirable. When, by contrast, a modification of the behavior is desirable, then some or all of these parameters are implemented in a manner so as to be programmable. Their respective values must then be stored in a configuration memory, or data carrier 6. The individual memory elements can thereby be arranged in concentrated form or can be locally allocated to the respective neuron.

Modification of the stored parameters can occur either by external programming of the memory elements and/or with an algorithm implemented in the circuit. The modification is thereby also possible during ongoing operation of the neural structure.

Figure 7:
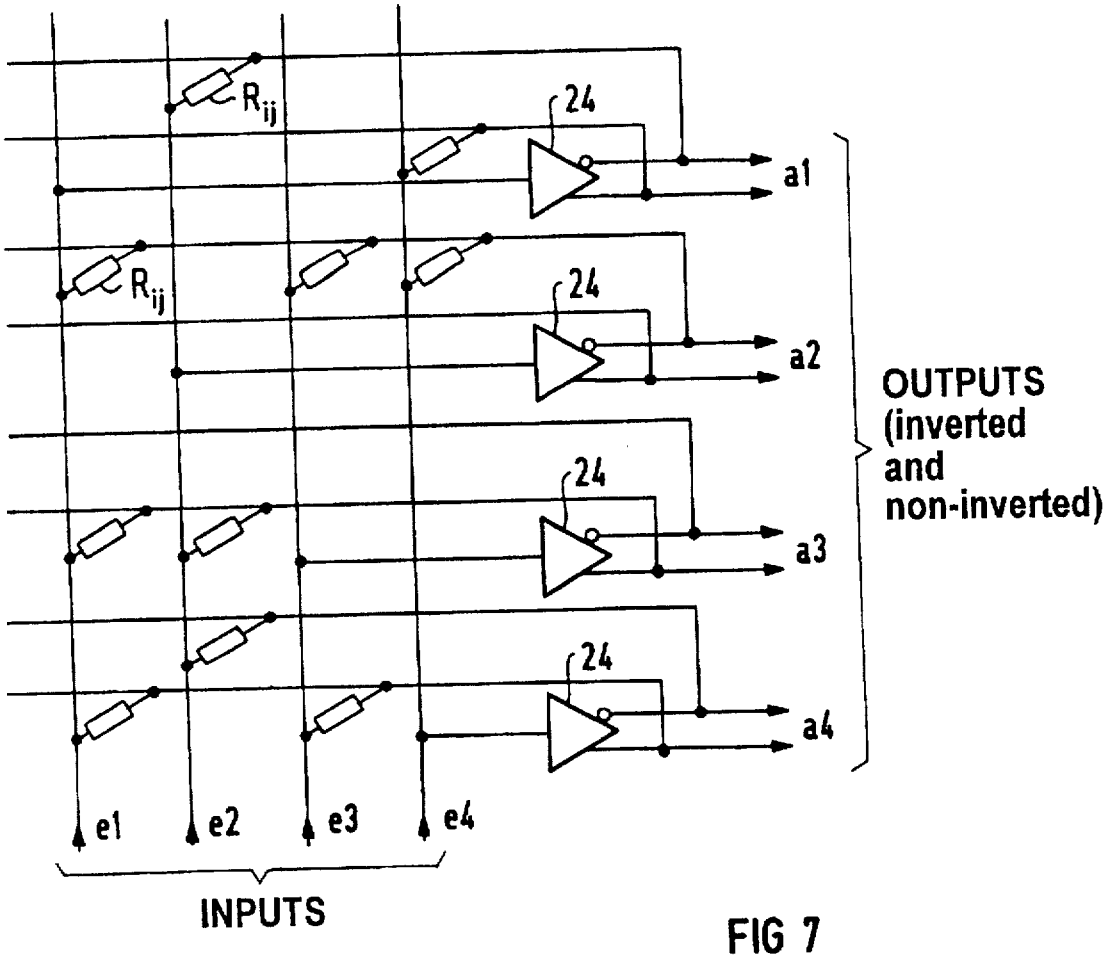
FIG. 7 is an exemplary circuit for the realization of the single-layer feedback network according to FIG. 5 suitable for use in the invention hearing aid.

FIG. 7 shows an example of a circuit realization of a single-layer feedback network. Amplifiers 24 with respective complementary outputs function as threshold elements. The weighting of the synapses between the outputs and inputs of the neurons ensues via the resistances $R_{ij}$. The addition of the input signals for each neuron (currents $I_{ij}=U_i/R_{ij}$) occurs at the circuit nodes at the input of each amplifier. The output signals of the amplifiers, and thus of the neural network 5, are the voltage signals $U_i$. The inputs of the circuit are referenced e1–e4 and inverted and non-inverted pairs of outputs of the circuit are referenced a1–a4.

Figure 8:
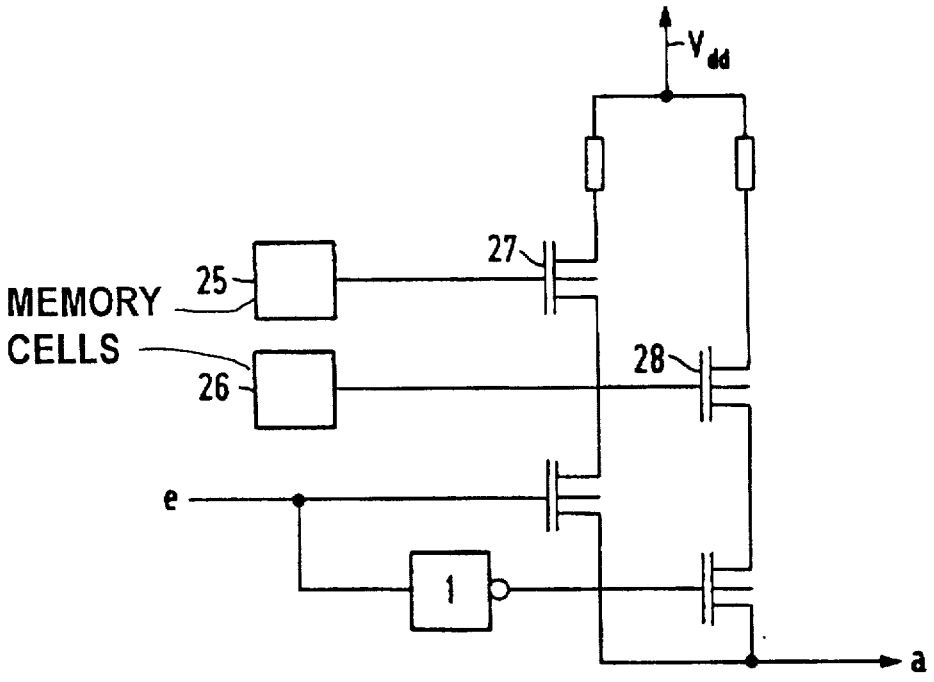
FIG. 8 is an exemplary circuit for realizing a synapse with programmable junction strength suitable for use in the invention hearing aid.

FIG. 8 shows a possible circuit realization of a synapse (weighted input of a neuron) with programmable weighting. Only the weights +1, −1 and 0 are thereby possible and the signals to be transmitted by this synapse can only assume the logical values 0 and 1. When both memory cells 25 and 26 are programmed such that they inhibit the respectively connected switching transistor 27 or 28, then the output a is independent of the input e; the synapse thus represents an interruption (synaptic weight 0). When, by contrast, the memory cell 25 is programmed such that it closes the switch formed by the transistor 27 and the memory cell 26 is programmed such that it opens the switch, formed by the transistor 28 then a current (logic 1) flows from the output a when the input is logical 1 and no current (logic 0) flows when the input is logic 0. The synapse thus acts as a synapse having the weight +1. When both memory cells 25 and 26 are inversely programmed compared to the preceding description, then the inverse logic behavior arises. The synapse then acts as a synapse having the weight −1. $V_{dd}$ in the drawing indicates the circuit connection to the supply voltage.

Figure 9:
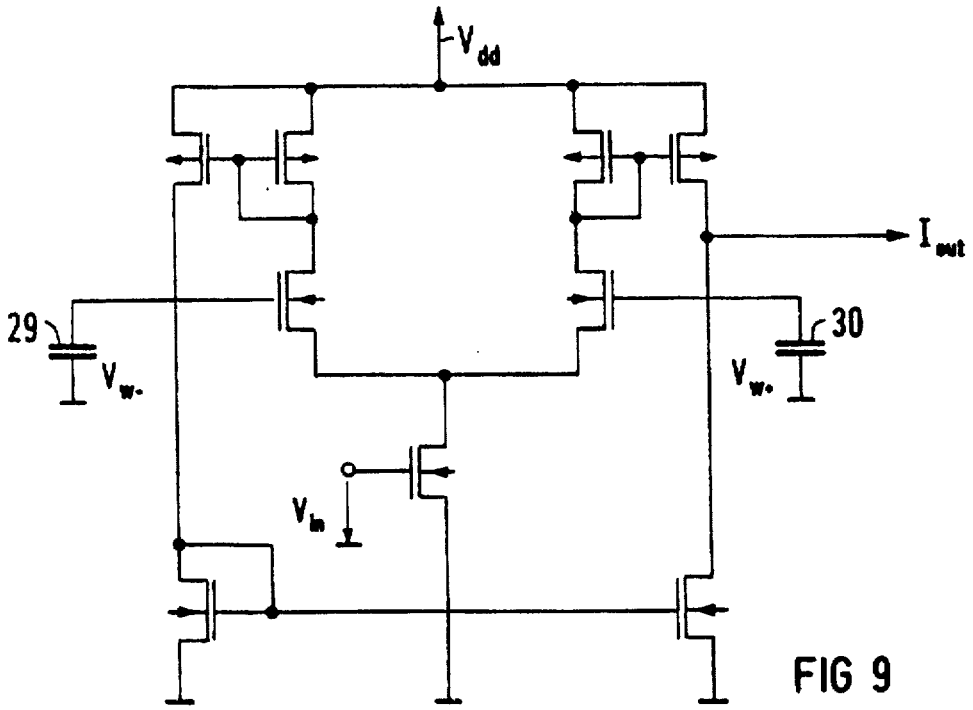
FIG. 9 is an embodiment of a circuit for a synapse having programmable, variable synaptic weight suitable for use in the invention hearing aid.

FIG. 9 shows a possible realization of a programmable synapse with variable synaptic weighting. It operates according to the principle of a multiplier. The weight of each synapse is stored as the difference between two analog voltage values at two capacitors 29 and 30, respectively. The output signal (current $I_{out}$) arises as the product of the input signal (voltage $V_{in}$) multiplied by the voltage difference ($V_w=V_{w+}-V_{w-}$) stored in the capacitors 29 and 30. Alternatively, the voltages $V_{w+}$ and $V_{w-}$ may be stored at the floating gates of corresponding EEPROM transistors, so that a non-volatile storing of the synapse weight is also possible.

An advantageous employment of neural structures in the hearing aid of the invention is the separation of independent, mixed signals, i.e., for example, the separation of a voice signal from background noise. For this purpose, the neural structure of the neural networks requires just as many independent signal inputs as there are independent signals to be separated from one another. This can be achieved in the hearing aid of the invention by utilizing a number of microphones, preferably arranged such that the signals to be separated arrive at each microphone with optimally different strength.

Figure 11:
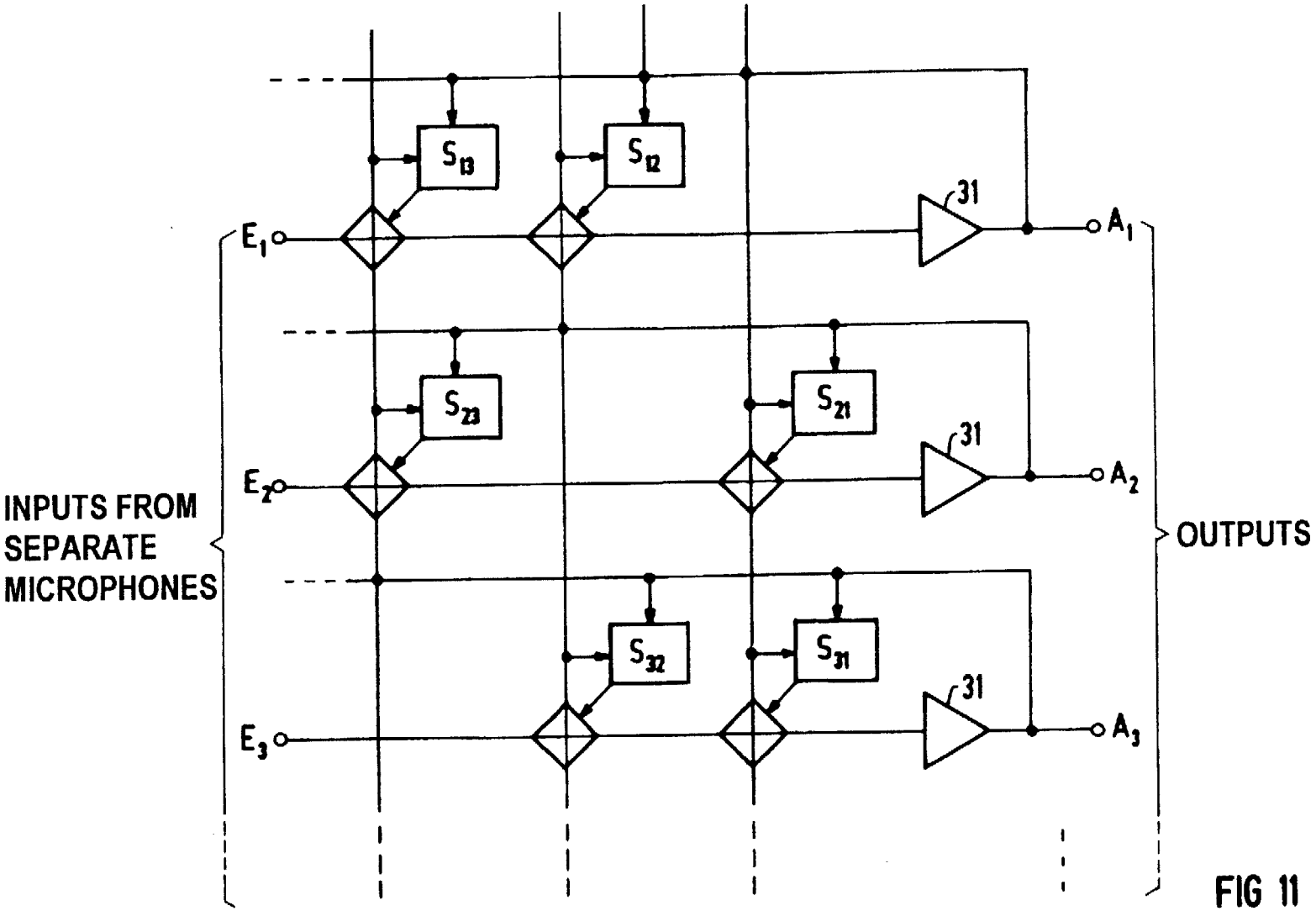
FIG. 11 is an exemplary circuit for a single-layer feedback network for separating mixed, independent signals, for example three input signals $E_1$, $E_2$, $E_3$ to form three output signals $A_1$, $A_2$, $A_3$ suitable for use in the invention hearing aid.

FIG. 11 shows in general how a single-layer feedback network structure can be employed for separating the signals. The neural structure is supplied with the signals of the individual microphones at inputs $E_1$, $E_2$, $E_3$ . . . and the independent signals separated from one another are present at outputs $A_1, A_2, A_3 \ldots$—after a specific learning time—for further-processing or for supply the earphone 3. In practice, the further-processing or supply of only one (desired) output signal ensues, whereas the other output signals are discarded.

Figure 10:
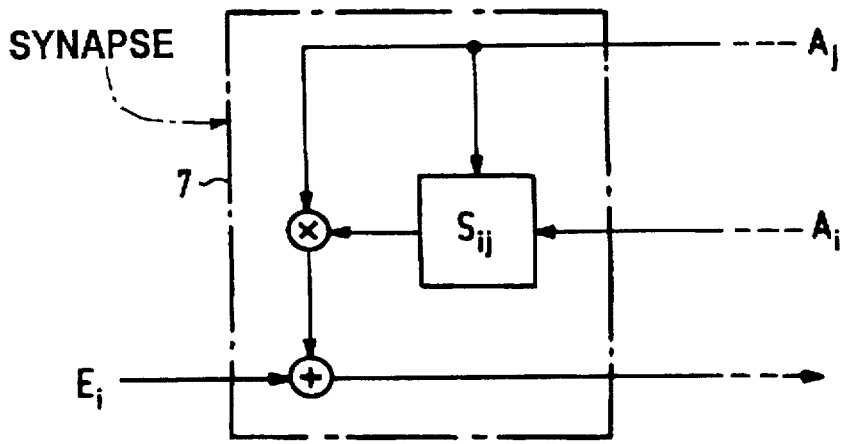
FIG. 10 is a block circuit diagram of a synapse having variable synaptic weight between an input $E_i$ and an output $A_j$ of the neural network suitable for use in the invention hearing aid.

A suitable quantity $S_{ij}$ (or a function) independently defines the synaptic weight for each synapse 7. The quantities $S_{13}, S_{12}, S_{21}, S_{23}, S_{31}, S_{32} \ldots$ or, in general $S_{ij}$ thereby represent the learning function of the neural structure. A possible realization of the synaptic weight of the synapse 7 is shown in FIG. 10. The fed back output signal $A_j(t)$ multiplied by a quantity $S_{ij}(t)$ is added to the input signal $E_i(t)$. The quantity $S_{ij}(t)$ is in turn a function of the two quantities $A_i(t)$ and $A_j(t)$, whereby the prior history of $S_{ij}(t)$ generally also enters into the calculation of $S_{ij}(t)=S(A_i(t), A_j(t))$.

Figure 12:
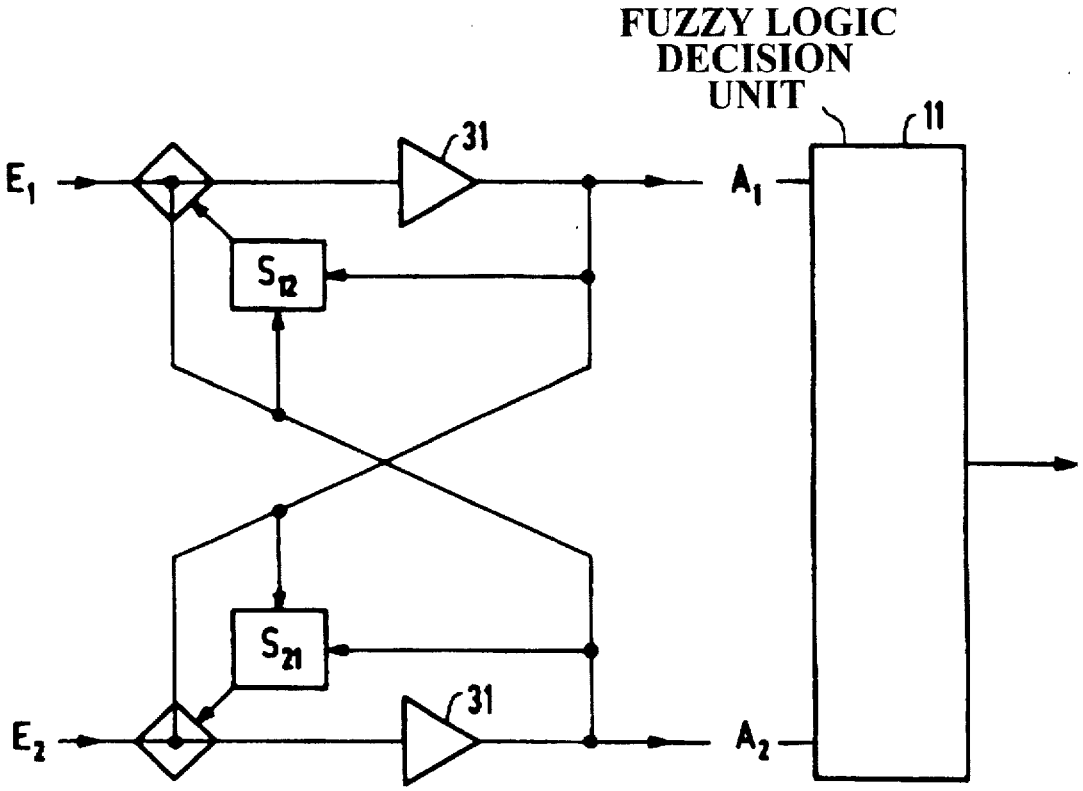
FIG. 12 is an exemplary circuit of a single-layer feedback network for separating two mixed, independent signals, namely two input signals $E_1$, $E_2$ to form two output signals $A_1$, $A_2$ suitable for use in the invention hearing aid.

In the simplest case—for the separation of two independent signals—, the neural structure is reduced as shown in FIG. 12. A possible realization of the quantities $S_{ij}(t)$ for the two synapses is:

$$S_{12}=c\cdot\int f(A_1)\cdot g(A_2)\cdot dt$$

$$S_{21}=c\cdot\int f(A_2)\cdot g(A_1)\cdot dt,$$

wherein c is thereby a constant and f and g are two non-equal, non-even functions (for example, $f(x)=x$, $g(x)=\tanh(x)$. The realization of the described, neural structures is fundamentally possible with digital or analog circuit technology (or a combination thereof). The values of the quantities $S_{12}, S_{21} \ldots S_{ij}$ can be stored in a manner which always permits them to be fetched, for example by means of a user selection of an auditory situation, with the same signal processing function or the learning process of the neural structure being restarted by the user in order to adapt the signal processing to a new acoustic ambient situation. Likewise, a continuous, automatic adaptation of the neural structure is possible in order to continuously adapt to ongoing, slight modifications of the acoustic ambient situation.

Figure 13:
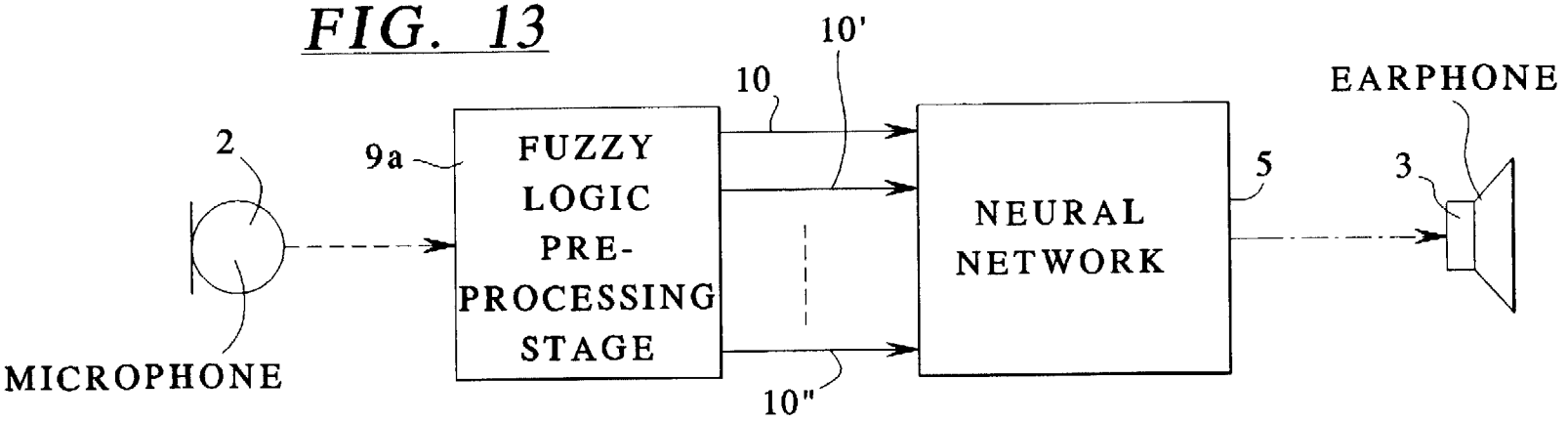
FIG. 13 illustrates a signal path from a microphone via a signal processing stage and a neural network to the earphone in a second embodiment of the hearing aid of FIG. 1.

An advantageous realization of the signal processing in the hearing aid can be composed of the combination of principles of the neural networks and fuzzy logic. Various approaches are thereby possible:

Employment of fuzzy logic in the pre-processing of the input signal for acquiring the sub-signals 10, 10', 10" . . . for the neural network. As FIG. 13 shows, the neural network 5 is preceded by a signal preprocessing stage 9*a* that operates according to the principle of fuzzy logic.

The employment of fuzzy logic in the selection of one of the three or more signals separated by the neural network. As schematically shown in FIG. 12, the neural structure of the neural network has a decision stage 11 allocated to it for the selection of the usable output signal, this decision stage 11 operating according to the principles of fuzzy logic.

Figure 14:
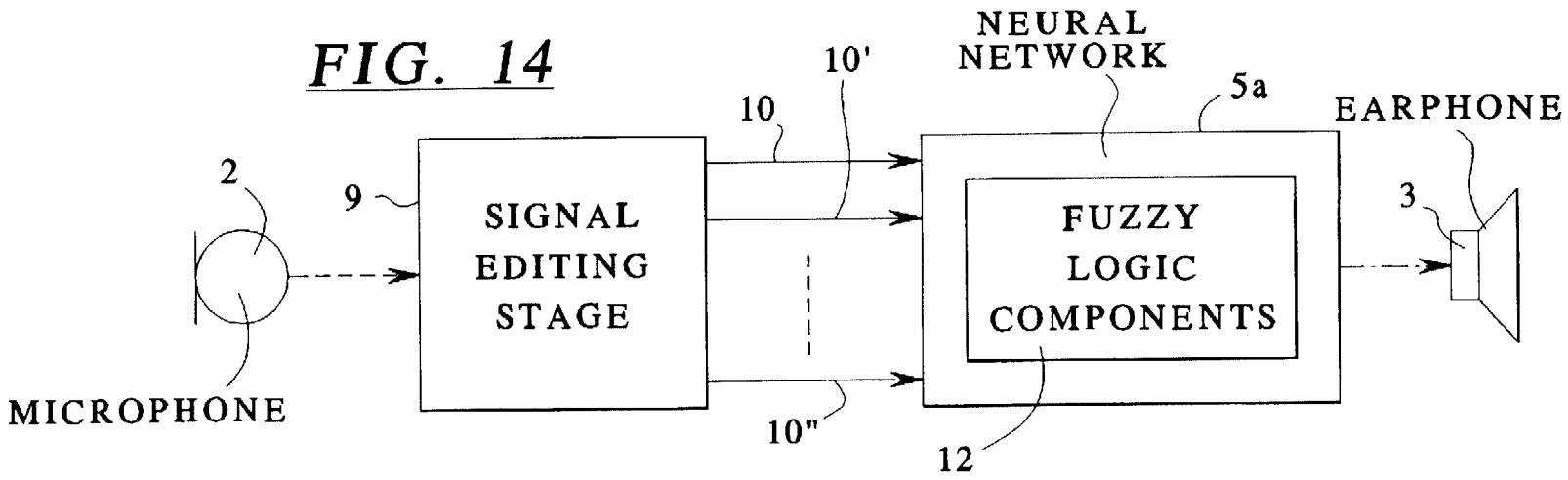
FIG. 14 illustrates a signal path from a microphone via a signal processing stage and a neural network to the earphone in a third embodiment of the hearing aid of FIG. 1.

Moreover, the neural network 5 itself may include a number of components operating according to the principles of fuzzy logic, as shown in the embodiment of FIG. 14 wherein a neural network 5*a* contains fuzzy logic components 12.

Limiting amplifiers 31 are also included in the neural networks in FIGS. 11 and 12. According to FIG. 12, the neural structure is implemented as a single-layer feedback network which has two inputs $E_1$, $E_2$ and two synapses, whereby the limiting amplifiers 31 are provided in the signal paths of the inputs $E_1$, $E_2$ to the two outputs $A_1$, $A_2$, and whereby each output signal is multiplied by a quantity $S_{ij}$ and is added to the other input signal, and whereby, further, the quantity $S_{ij}$ is a function of the two output signals.

The principal functioning as well as an exemplary circuit realization of the functions "fuzzifying", "inference formation" and "defuzzifying" necessary for the fuzzy logic processing are disclosed in co-pending U.S. application, Ser. No. 08/393,681 (Programmable Hearing Aid with Fuzzy Logic Control of the Transmission Characteristics, Weinfurtner) Filed Feb. 24, 1995 and assigned to the same assignee (Siemens AG) as the present invention.

Substantial advantages of the invention arise from the improved signal processing in the hearing aid by employing new algorithms embodied in the neural network. A further significant advantage is the improved separation of useful signals and unwanted noise as a result of the capability of separating independent, mixed signals, and by continuous optimization of the signal processing characteristics as a result of "learning" during ongoing operation.

Although modifications and changes may be suggested by those skilled in the art, it is the intention of the inventors to embody within the patent warranted hereon all changes and modifications as reasonably and properly come within the contribution of the art.

I claim as my invention:

1. A hearing aid comprising:

at least one microphone;

an earphone;

an amplifier and transmission stage connected between said microphone and said earphone, said amplifier and transmission stage having a signal path therein between said microphone and said earphone and having a plurality of adjustable transmission characteristics acting on a signal in said signal path; and neural network means connected in said signal path in said amplifier and transmission stage for processing signals in said signal path by adjusting said transmission characteristics dependent on current ambient auditory conditions for at least partially correcting a hearing impairment of a hearing aid user, said neural network means comprising a plurality of synapses, each synapse having a synaptic weight associated therewith, with each synaptic weight being permanently set.

2. A hearing aid as claimed in claim 1 wherein said microphone receives useful auditory signals and noise signals and emits electrical useful signals and electrical noise signals respectively corresponding thereto, and wherein said neural network means comprises means for separating said electrical useful signals from said electrical noise signals.

3. A hearing aid as claimed in claim 1 comprising a plurality of microphones, and wherein said neural network means comprises a plurality of signal inputs respectively allocated to said plurality of microphones.

4. A hearing aid as claimed in claim 1 further comprising signal preprocessing means, connected between said microphone and said neural network means, for preprocessing signals from said microphone and for emitting a plurality of edited signals respectively at a plurality of edited signal outputs, and wherein said neural network means comprises a plurality of signal inputs respectively connected to said plurality of edited signal outputs.

5. A hearing aid as claimed in claim 4 wherein signal preprocessing means comprises means for dividing said signal from said microphone into a plurality of said preprocessed signals in respectively different frequency ranges.

6. A hearing aid as claimed in claim 1 wherein said neural network means comprises a single-layer feedback network 7. A hearing aid as claimed in claim 1 wherein said neural network means comprises a multi-layer feedback-free network.

8. A hearing aid as claimed in claim 1 wherein said neural network means comprises a combination of a single-layer feedback network and a multi-layer feedback-free network.

9. A hearing aid comprising:

at least one microphone:

an earphone:

an amplifier and transmission stage connected between said microphone and said earphone, said amplifier and transmission stage having a signal path therein between said microphone and said earphone and having a plurality of adjustable transmission characteristics acting on a signal in said signal path; and neural network means connected in said signal path in said amplifier and transmission stage for processing signals in said signal path by adjusting said transmission characteristics dependent on current ambient auditory conditions for at least partially correcting a hearing impairment of a hearing aid user, said neural network means comprising a plurality of synapses, each synapse having a synaptic weight associated therewith and each synaptic weight being variable; control means connected to each synapse for varying the synaptic weight associated therewith; and data carrier means for supplying data to said control means for modifying the synaptic weights respectively associated with said synapses.

10. A hearing aid as claimed in claim 9 wherein said control means comprises mean for modifying said synaptic weights at predetermined points in time.

11. A hearing aid as claimed in claim 9 wherein said control means comprises means for continuously modifying said synaptic weights.

12. A hearing aid as claimed in claim 1 wherein said neural network means comprises a plurality of synapses each having an input signal and an output signal with a fed back output signal of a synapse being added to the input signal for that synapse.

13. A hearing aid as claimed in claim 1 wherein said neural network means comprises a plurality of synapses each having an input signal and an output signal, with a fed back output signal of a synapse being multiplied by a function to produce a product, with said product being added to the input signal for that synapse.

14. A hearing aid as claimed in claim 13 wherein said function comprises $$S_{ij}=c\cdot\int f(A_i(t)\cdot g(A_j(t)\cdot dt$$

wherein c is a constant, $A_i(t)$ is the output signal of the synapse having said input signal, $A_j(t)$ is the output from another synapse in said neural network means, and f and g are two unequal, non-even functions.

15. A hearing aid as claimed in claim 1 wherein said neural network means comprises a single-layer feedback network having two inputs, two synapses, two outputs, and two limiting amplifiers respectively disposed in signal paths between said input and said outputs, with said synapses being respectively connected to said inputs and to said outputs so that each output signal is multiplied by a function and is added to the input signal of the other synapse, said function being a function of the two output signals.

16. A hearing aid as claimed in claim 1 wherein said neural network means has a plurality of output signals, and further comprising decision means for selecting one of said output signals for further processing.

17. A hearing aid as claimed in claim 1 wherein said neural network means comprises a plurality of components operating according to principles of fuzzy logic.

18. A hearing aid as claimed in claim 1 further comprising fuzzy logic signal preprocessing means, preceding said neural network means, for preprocessing signals from said microphone according to principles of fuzzy logic.

19. A hearing aid as claimed in claim 1 wherein said neural network means comprises a plurality of outputs, and further comprising fuzzy logic decision means, supplied with said outputs from said neural network means, for selecting one of said output signals for further processing according to principles of fuzzy logic.

20. A hearing aid as claimed in claim 9 wherein said microphone receives useful auditory signals and noise signals and emits electrical useful signals and electrical noise signals respectively corresponding thereto, and wherein said neural network means comprises means for separating said electrical useful signals from said electrical noise signals.

21. A hearing aid as claimed in claim 9 comprising a plurality of microphones, and wherein said neural network means comprises a plurality of signal inputs respectively allocated to said plurality of microphones.

22. A hearing aid as claimed in claim 9 further comprising signal preprocessing means, connected between said microphone and said neural network means, for preprocessing signals from said microphone and for emitting a plurality of edited signals respectively at a plurality of edited signal outputs, and wherein said neural network means comprises a plurality of signal inputs respectively connected to said plurality of edited signal outputs.

23. A hearing aid as claimed in claim 22 wherein signal preprocessing means comprises means for dividing said signal from said microphone into a plurality of said preprocessed signals in respectively different frequency ranges.

24. A hearing aid as claimed in claim 9 wherein said neural network means comprises a single-layer feedback network.

25. A hearing aid as claimed in claim 9 wherein said neural network means comprises a multi-layer feedback-free network.

26. A hearing aid as claimed in claim 9 wherein said neural network means comprises a combination of a single-layer feedback network and a multi-layer feedback-free network.

27. A hearing aid as claimed in claim 9 wherein said neural network means comprises a plurality of synapses each having an input signal and an output signal with a fed back output signal of a synapse being added to the input signal for that synapse.

28. A hearing aid as claimed in claim 9 wherein said neural network means comprises a plurality of synapses each having an input signal and an output signal, with a fed back output signal of a synapse being multiplied by a function to produce a product, with said product being added to the input signal for that synapse.

29. A hearing aid as claimed in claim 28 wherein said function comprises $$S_{ij}=c\cdot\int f(A_i(t)\cdot g(A_j(t)\cdot dt$$

wherein c is a constant, $A_i(t)$ is the output signal of the synapse having said input signal, $A_j(t)$ is the output from another synapse in said neural network means, and f and g are two unequal, non-even functions.

30. A hearing aid as claimed in claim 9 wherein said neural network means comprises a single-layer feedback network having two inputs, two synapses, two outputs, and two limiting amplifiers respectively disposed in signal paths between said input and said outputs, with said synapses being respectively connected to said inputs and to said outputs so that each output signal is multiplied by a function and is added to the input signal of the other synapse, said function being a function of the two output signals.

31. A hearing aid as claimed in claim 9 wherein said neural network means has a plurality of output signals, and further comprising decision means for selecting one of said output signals for further processing.

32. A hearing aid as claimed in claim 9 wherein said neural network means comprises a plurality of components operating according to principles of fuzzy logic.

33. A hearing aid as claimed in claim 9 further comprising fuzzy logic signal preprocessing means, preceding said neural network means, for preprocessing signals from said microphone according to principles of fuzzy logic.

34. A hearing aid as claimed in claim 9 wherein said neural network means comprises a plurality of outputs, and further comprising fuzzy logic decision means, supplied with said outputs from said neural network means, for selecting one of said output signals for further processing according to principles of fuzzy logic.

35. A hearing aid as claimed in claim 9 wherein said control means comprises means for programming the synaptic weights respectively associated with said synapsis.

* * * * *